United States Patent [19]

Redman

[11] 4,103,199

[45] Jul. 25, 1978

[54] ELECTRONIC DEVICE FOR PROCESSING SIGNALS IN THREE DIMENSIONS

[75] Inventor: Charles Redman, 2020 Huntington Dr., Los Cruces, N. Mex. 88001

[73] Assignee: The United States of America as represented by the Secretary of the Army, Washington, D.C.

[21] Appl. No.: 695,489

[22] Filed: Jun. 14, 1976

Related U.S. Application Data

[62] Division of Ser. No. 556,525, Mar. 7, 1975, Pat. No. 3,982,147.

[51] Int. Cl.[2] ..... H01J 39/06; H01J 31/49

[52] U.S. Cl. ..... 313/101; 313/388

[58] Field of Search ..... 313/388, 309, 409–411, 313/105 CM, 103 CM, 104, 380; 250/338 (U.S. only)

[56] References Cited

U.S. PATENT DOCUMENTS

| | | | |
|---|---|---|---|
| 3,665,241 | 5/1972 | Spindt et al. | 313/309 X |
| 3,755,704 | 8/1973 | Spindt et al. | 313/309 |
| 3,950,645 | 4/1976 | Rotstein et al. | 313/388 X |
| 3,970,887 | 7/1976 | Smith et al. | 313/309 |

*Primary Examiner*—Robert Segal

*Attorney, Agent, or Firm*—Nathan Edelberg; Michael Zelenka; Jeremiah G. Murray

[57] ABSTRACT

An electronic device for processing optic, infrared or electronic signals in three dimensions, that is, area and time. The device features an amplification function and includes the use of melt grown oxide metal ceramic substrate material which allows high frequency operation and utilizes microchannel amplifier techniques to reduce operational charge buildup.

4 Claims, 11 Drawing Figures

ELECTRONIC DEVICE FOR PROCESSING SIGNALS IN THREE DIMENSIONS

This is a division, of application Ser. No. 556,525, filed Mar. 7, 1975, and now U.S. Pat. No. 3,982,147, granted Sept. 21, 1976.

BACKGROUND OF THE INVENTION

The present invention pertains to an electronic device which may be used as a new and improved electron bombarded semiconductor amplifier and for the processing of optic, infrared or electronic signals in three dimensional (area and time) applications. The device particularly lends itself to use in detectors, electronic storage units and converters. Previous electron-bombarded semiconductor amplifiers consisted of two metallic electrodes separated by a region of fully depleted semiconductor material. This creates a drift region for injected carriers and provides for carrier collection at a high speed. The injection of carriers in the electron bombarded semiconductor amplifier is accomplished by bombarding one metal contact with an electron beam having energy in the order of 10kev. The electrons in the beam penetrate the thin metal contact and enter the semiconductor with considerable energy. The energy is dissipated in the formation of electron-hole pairs which usually occurs near the edge of the semiconductor region. These carrier pairs are separated by a high electrical field at the semiconductor. One type of carrier moves through the drift region of the semiconductor and is collected at the far contact; the other returns very quickly to the bombarded contact. The reason for the high gain of these devices is that each electron in the bombarding beam creates several thousand electron-hole pairs in the semiconductor. These devices have been unsatisfactory in any application where directivity would be required for the drifting carriers or where the desired frequency of operation is limited by the capacitance of the device.

SUMMARY OF THE INVENTION

This invention utilizes a melt grown oxide metal ceramic material as described in Georgia Institute of Technology report No. 4 of the School of Ceramic Engineering entitled "Melt-Grown Oxide-Metal Composites" dated July 1972 sponsored by Advanced Research Projects Agency, Department of Defense, Contract No. DAAH01-71-C-1046 (distribution unlimited). The material is basically a ceramic interspersed with continuous parallel metal fibers of more or less a micron in diameter with an interfiber spacing of more or less five microns. Prior to the present application the material was used primarily for experimentation in the field of cold cathodes.

This raw material is cut, etched and deposited on in such a manner as described later herein so that a device is formed which provides millions of parallel, grid controlled, microchannel amplifiers with a separate cathode, metal fiber, for each channel. This parallel construction feature allows discreet area amplification not possible in the standard electron bombarded semiconductor amplifier, a property which enables exceptional resolution in an electron-image to deformographic-image converter. The new device also provides improved frequency response by reducing internal inductance and capacitance and thereby makes possible an area detector amplifier module, a device which detects and amplifies R.F. amplitude modulations in the thermal band. When used solely as an amplifier, the device can be constructed so as to provide secondary emission in the microchannels which adds to its inherent high gain.

DESCRIPTION OF THE DRAWINGS

All the figures are longitudinal sectional views on an enlarged scale in different stages of fabrication of a plurality of embodiments of An Electronic Device for Processing Signals in Three Dimensions according to this invention.

FIGS. *2a*, *2b* and *2c* show an input section of one embodiment of this invention in successive stages of fabrication.

FIGS. *3a*, *3b* and *3c* are corresponding views of an output section of this invention.

Figure 4:
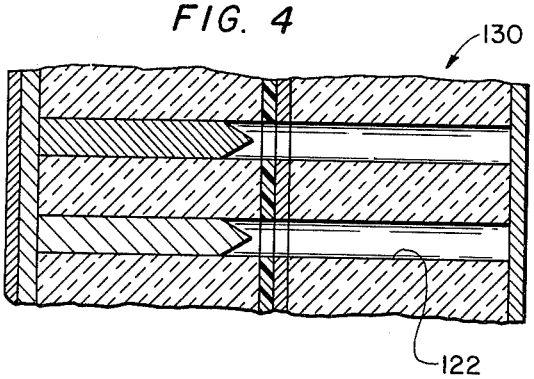

FIG. 4 shows a complete embodiment of this invention in simple form.

Figure 5:
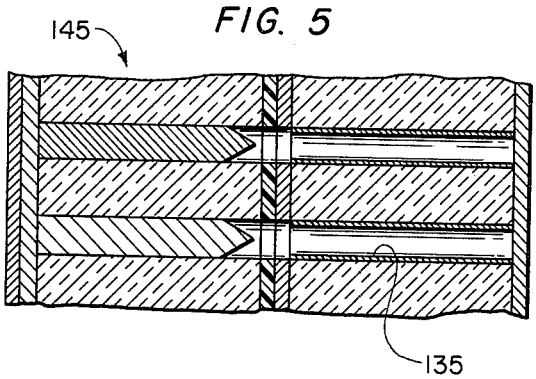
Figure 6:
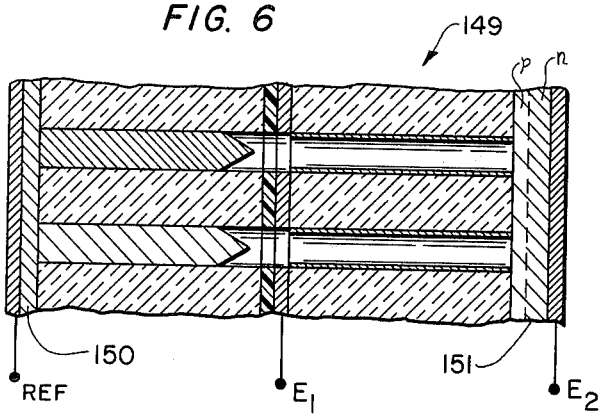
Figure 7:
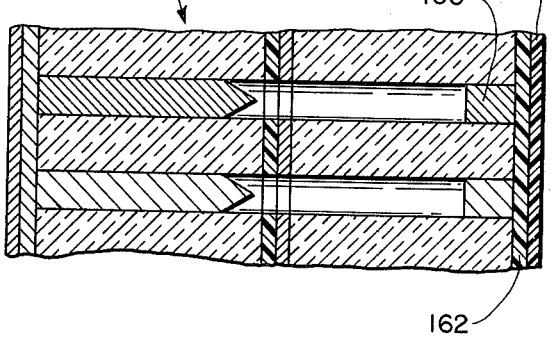

FIGS. 5, 6 and 7 picture embodiments used as an electron bombarded amplifier, an area detector amplifier and an electron image to deformographic image converter, respectively.

DESCRIPTION OF THE PREFERRED EMBODIMENT

Figure 1:
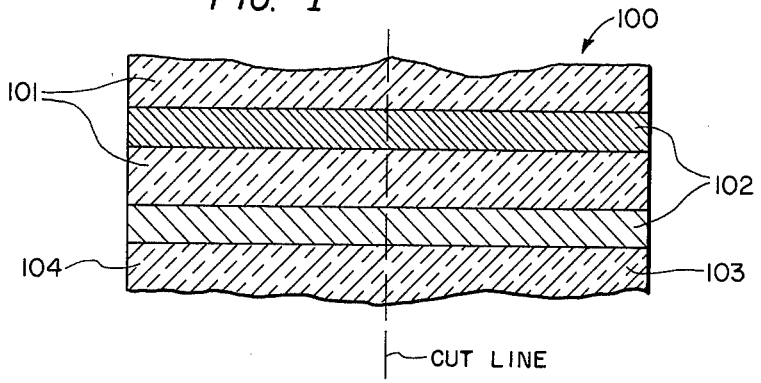
FIG. 1 is prior art and illustrates the unprocessed melt grown oxide metal ceramic substrate material used in all embodiments of this invention.
Figure 2A:
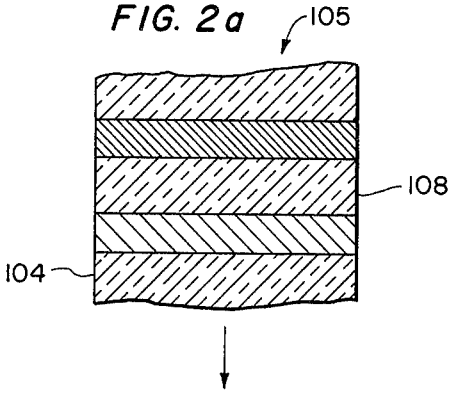
Figure 3A:
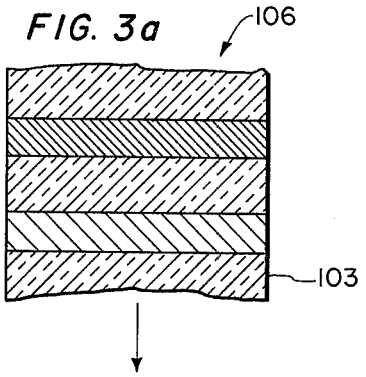
Figure 2B:
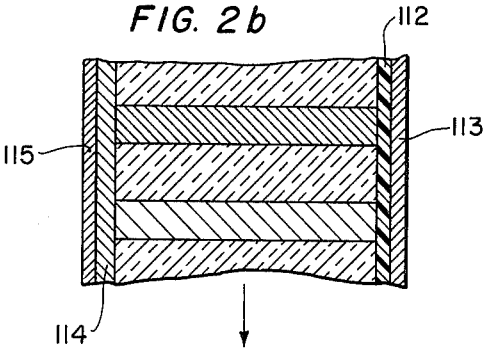
Figure 3B:
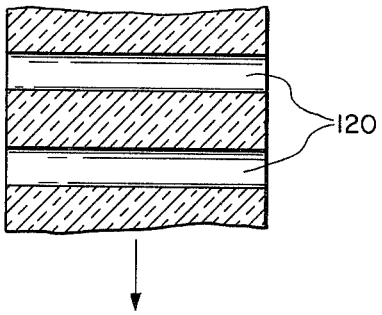
Figure 2C:
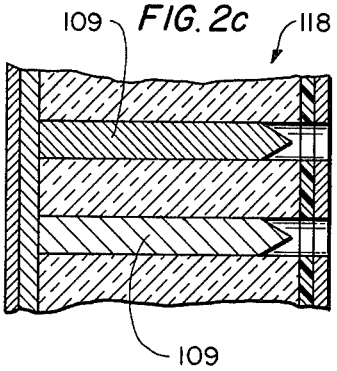
Figure 3C:
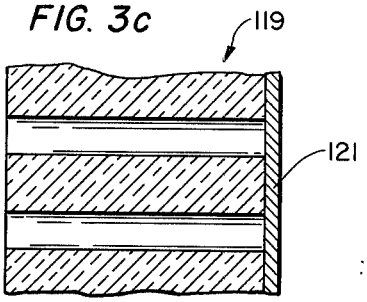

Three preferred embodiments of the invention are illustrated in FIGS. 5, 6 and 7. To better understand the construction and functioning of any of the preferred embodiments, however, it is desirable first to discuss the treatment of the melt grown oxide-metal ceramic substrate material as used in this type of device. FIG. 1 illustrates a longitudinal section of a sample 100 of melt grown oxide-metal ceramic substrate material. The sample is about 1,100 microns in length and is comprised of a ceramic matrix 101 having spaced parallel metal fibers 102, that are continuous between the end faces 103, 104 of the sample 100. The metal fibers 102 may be approximately 0.2 microns in diameter with an interfiber spacing of approximately 5 microns. The sample 100 is cut perpendicular to the metal fibers 102 so as to make two similar samples 105, 106 illustrated in FIGS. 2A and 3A. The sample 105 is approximately 500 microns long and will be used as the input substrate. The second substrate 106 is approximately 600 microns long and will be used as the output substrate. The transverse cross section of the substrate may be of any convenient shape although the preferred embodiment utilizes a 16mm square. Both end faces of each substrate 105, 106 are polished before further processing. A microfilm insulating layer 112, such as aluminum oxide, is deposited on end face 108 of the input substrate 105 as illustrated in FIG. 2B. A conducting microfilm 113 is then deposited on the microfilm insulating layer 112. This conducting microfilm 113 will serve as a control grid. A layer of semiconducting material 114 is deposited on the input end face 104 of the input substrate 105. A thin conducting film 115 is then deposited on the semiconducting material 114. This thin conducting film 115 will serve as an input conductor. A preferential etch is then applied to the conducting microfilm 113 and the insulating layer 112 while a potential is applied between the conducting microfilms 113, 115. This results in etching holes through the conducting microfilm 113 and the insulating layer 112 and exposing ends of the metal fibers 102. The conducting microfilm 113 thus etched becomes the previously mentioned control grid. Continued etching results in the pointing of the metal fibers 102. These pointed metal fibers will serve as input fibers 109. The control grid 113 is in close proximity to, but spaced from the input fibers 109. The structure shown in FIG. 2*c* is a complete input section 118. A complementary output section 119 is fabricated similarly. First, the output substrate 106 is preferentially etched so as to dissolve the metal fibers 102 leaving tubes 120 as in FIG. 3*b*. A conducting microfilm 121 is then deposited on the output face 103 of the output substrate 106 to serve as an output conducting film. The structure shown in FIG. 3*c* is a complete output section 119. The input and output sections 118, 119 are then joined together face-to-face as shown in FIG. 4 in an evacuated chamber so as to seal vacuums in the tubes 120 left by the dissolution of the metal fibers 102. The joined together sections form a configuration 130 which represents a crude final form of the device. Its operation is similar to that of a standard electron bombarded semiconductor amplifier. In use, a positive potential is applied to the output conductor 121 relative to input conductor 115 and the input face 131 of the device 130 is bombarded with electrons having high kinetic energy, in the order of 10 kev. These high energy electrons transit the input conductor 115 and enter the semiconductor 114 with considerable energy. This energy is absorbed in collisions resulting in the formation of charge-carrying electron-hole pairs, predominantly near the interface of the semiconductor region 114 and the input conductor 115. The carriers separate, the holes migrating to the input conductor 115 and the electrons migrating across the thickness dimension of the semiconductor film 114 and into the input fibers 109. The electrons are emitted from the tips of the input fibers 109 but the rate of emission is significantly increased by biasing the control grid 113 in such a manner as to draw the electrons off. The drawn-off electrons transit the evacuated tubes 120 and are collected by the output conductor 121. While the configuration 130 described above will operate, its performance is significantly improved by the employment of existing microchannel technology. The most significant drawback of the configuration 130 described above is the possibility of back-biasing. Since electrons are emitted from the ends of the input fibers 109 with a wide dispersion angle, many electrons will collide with the walls 122 of the evacuated tubes 120 and will free additional electrons which migrate down the evacuated tubes 120 and leave the tube walls 122 positively charged. This positive charge build-up can continue until the device 130 is back-biased. The condition can be avoided by controlling the grid bias and potential across the device so that electrons emitted from the input fibers 109 do not attain sufficient kinetic energy to free electrons from the evacuated tube walls 122 upon collision therewith. However, when electrons are not drained off at a sufficient rate, frequency response of the device 130 is limited. The tube walls 122, as shown in the embodiment of FIG. 5, are lined with resistive material 135, such as a dielectric oxide, to prevent back-biasing of the device 130 due to charge buildup. This lining of resistive material 135 is applied by vapor deposition techniques prior to assembly of the device 130. With the tube walls 122 lined with resistive material 135, electrons emitted from the resistive material 135 as a result of electron bombardment migrate down the evacuated tubes 120 as a result of the biasing potential. The freed electrons leave holes which migrate down the resistive material 135 toward the output conductor 121. When the electrons reach the end of the evacuated tubes 120 they pass into the output conductor 121. At this time, some of the electrons combine with the holes created in the resistive material 135 while the remainder are drained off the output conductor and represent the output of the device 121. The secondary emissions in the evacuated tubes 120 do not add to the gain of this device, since for each electron freed from the tube walls 122 another electron is substituted to fill the resultant hole. In order to utilize these secondary emissions for the purpose of additional gain, a separate power source must be used to supply electrons to the resistive material 135.

The embodiment of the invention shown in FIG. 6 acts as a detector of rf modulation of an infrared signal. This embodiment includes a device 149 constructed in a manner similar to the device 145 of FIG. 5. At the input side of the device 149, instead of semiconductor material 114, there is included a pyroelectric layer 150. The pyroelectric layer 150 is a dielectric below a given temperature and blocks current flow. Above that given temperature it conducts and its conductivity increases with temperature. At the output face of the device a semiconductor material 151, having a highly conductive P region and a depleted N region, is sandwiched between the output face of the substrate and the output conductor 121 with the P side of the semiconductor abutting the output ends of the evacuated tubes 120. Operation of the device 149 requires two biasing potentials E1 and E2. E1 is on the grid 113 and E2 is on the output conductor 121 whereby the grid 113 is slightly positive relative to the input conductor 115 and the output conductor 121 is highly positive relative to the input conductor 115. In the absence of an input signal application of E1 to the grid 113 initiates a current through the input fibers 109, the grid 113, the E1 power source, and the input conductor 115. Current flow however is blocked by the nonconductive pyroelectric 150. Application of a radiant energy input signal sufficient to cause the temperature of the pyroelectric layer to exceed the given temperature causes conduction in the pyroelectric 150 and therefore electron emission from the tips of the input fibers 109. These emitted electrons are accelerated down the evacuated tubes 120 due to the urging of the E2 potential. Collisions with the resistive material 135 on the tube walls 122, resulting in the freeing of additional electrons occur in a manner similar to that described previously herein. In this device 144, however, electrons are accelerated to a much higher average kinetic energy. Those electrons which have lower kinetic energy enter the P region of the semiconductor and do not pass to the N region but migrate through the P region and fill the holes resulting from the freed electrons in the resistive material 135. Higher energy electrons pass through the P region and into the N region of semiconductor 151 where their high kinetic energy is dissipated in the formation of electron-hole pairs. The excess electrons in the N region are drained off through the output conductor 121 as output current. Instantaneous output current follows instantaneous temperature of the pyroelectric layer when the temperature exceeds the given temperature. Varying output current indicates the presence of a modulation signal and follows the magnitude of the modulation signal. Electrons removed from the pyroelectric 150 during the positive temperature cycles are replaced by the E1 power source during the negative temperature cycles.

A third preferred embodiment of the device is illustrated in FIG. 7. The device 166 serves as an Electron Image to Deformographic Image Converter. The Electron Image to Deformographic Image Converter 166 is a device to accept high kinetic energy electron images in either cathode ray beam form or as released from image intensifier cathodes, multiply the number of image electrons, convert to an electrostatic image and correspondingly deform an optically reflecting conducting surface 164. The construction of the device 166 is most similar to that illustrated in FIG. 4 except that short lengths of metal fibers 160 remain in the evacuated tubes 120 at the output end of the device 166 and serve as output fibers. In addition, in place of the output conductor 121 there is used a deformographic film layer 162.

Deformographic films are well known in the art and are described in the technical literature. I.B.M. has done considerable work on using deformographic films with the aid of Schlieren optics to project images.

This deformographic film layer 162 is sandwiched between a light reflecting conductive film 164 and the output face 120 of the substrate. Operation of this device 166 differs greatly from that of the devices previously described herein 145, 149.

Between any one of the output fibers 160 and the output conductor 164, the spacing occupied by deformographic film 162 will vary with voltage. For any image there is a distributed pattern of voltages on the output fibers 160 relative to the output film 164. Therefore, prior to imaging, it is necessary to eliminate random variations in polarity and magnitude among the voltages on the output fibers 160 with respect to the output film 164. These random variations will distort or otherwise detract from image quality. To accomplish this, all the output fibers 160 are raised to a common voltage level relative to the output film 164 that is substantially higher than the maximum level and then discharged together to an essentially common lower voltage relative to the output film 164. The first step in an image frame sequence is to bias the input conductor 115 and the grid 113 to approximately 500 volts positive with respect to the output fibers 160. Each output fiber 160 emits electrons through its tube 120 to the corresponding input fiber 109 on the left until the voltage across the evacuated tube 120 reaches the potential expected based on the input fiber to output fiber capacitance as compared to the output fiber to output film capacitance and the electron flow stops. Variations in the input to output fiber capacitance results in a charge variation across the deformographic film 162. It is desirable to keep this variation small.

The second step places the output metallic reflecting film 164 and the grid 113 at zero volts; the input conducting film 115 is biased slightly above negative 0.8 volts. The output fibers 160 were left with a positive charge with respect to the output conducting film 164 in step one. By causing electron emission from the input fibers 109 and holding the output film 164 at zero volts electrons will flow to the output fibers 160 until the output fibers 160 discharge to their emission point voltage. This destroys almost all charge variations across the deformographic film 162 from step one and leaves all the output fibers 160 at essentially grid voltage.

During steps one and two any electrons created in the semiconductor 114 by impact electrons are drained off to the plus voltage at the input conducting film 115 in step one and to the grid 113 in step two. In step three the grid to input film potential is reduced to just below the electron field emission point and the output metallic film 164 is placed at about 100 volts. This 100 volts is essentially between the input metal fibers 109 and the output metal fibers 160 since the input fiber to output fiber capacitance is small as compared to the capacitance between the output fiber 160 and the output conducting film 164. When a high energy electron beam impacts the semiconductor 164 it creates a number of electron hole pairs, in the order of two thousand for each 10 kev impacting electron. The number of electron hole pairs is used only as an example and since the device is fully electronically controllable the gain is adjustable. The holes migrate to the input film 115 and the electrons migrate down the input fibers 109. The first few electrons causes the input fiber to grid potential to return to the electron field emission point. The remainder move down the tube 120 to the output fibers 160 and charge them negative with respect to the output conducting film 164. The distribution of negative charges among the output fibers 160 is dependent upon the illumination pattern at the input conducting film 115. This negative charge distribution controls the deformation of the deformographic and light reflecting films 162, 164. An image is then obtained from the light reflecting film 164 through the use of Schlieren optics.

What is claimed is:

1. An area and time processing electronic device comprising:

an electrical insulator having opposed input and output faces;

a planar control grid, intermediate the input and output faces and substantially parallel thereto being integral with and traversing the electrical insulator, the combination of electrical insulator and control grid providing a plurality of parallel evacuated chambers which are continuous between the input and output faces;

a plurality of conducting fibers occupying the parallel evacuated chambers extending from the input face and terminating short of the control grid;

a layer of pyroelectric material deposited on the input face so as to seal the evacuated chambers;

a thin film conductor deposited on the pyroelectric material so as to sandwich the pyroelectric between the input face and the thin film conductor; and output means, including an output face seal, electrically coupled to the output face.

2. The device of claim 1 further comprising means in the evacuated chambers to prevent electronic charge buildup on the walls of the chambers.

3. The device of claim 2 wherein the means to prevent charge buildup on the walls of the chambers comprises a resistive coating on the chamber walls extending from the output face and terminating short of the grid.

4. The device of claim 3 wherein the output means comprises:

a semiconductor layer deposited on the output face so as to seal the evacuated chambers; and a thin film conductor deposited on the semiconductor layer so as to sandwich the semiconductor between the output face and the thin film conductor.

* * * * *